United States Patent [19]

Fiocchi

[11] 3,978,794

[45] Sept. 7, 1976

[54] BASE WAD FOR SHOTSHELLS

[75] Inventor: Giuseppe G. Fiocchi, Mandello Lario Como, Italy

[73] Assignee: Giulio Fiocchi, S.p.A., Lecco, Como, Italy

[22] Filed: Dec. 5, 1974

[21] Appl. No.: 529,610

Related U.S. Application Data

[63] Continuation-in-part of Ser. No. 429,094, Dec. 28, 1973, abandoned.

[52] U.S. Cl. ..... 102/42 R; 102/95

[51] Int. Cl.[2] ..... F42B 7/08

[58] Field of Search ..... 102/42 C, 95

[56] References Cited

UNITED STATES PATENTS

| | | | |
|---|---|---|---|
| 3,270,671 | 9/1966 | Daubenspeck et al. | 102/95 |
| 3,577,924 | 5/1971 | Findlay et al. | 102/42 R |
| 3,721,197 | 3/1973 | Hughes et al. | 102/95 |
| 3,804,019 | 4/1974 | Hurley | 102/42 R |

OTHER PUBLICATIONS

The Condensed Chemical Dictionary, Eighth Ed., Von Nostrand Reinhold Co., pp. 706, 707.

*Primary Examiner*—Verlin R. Pendegrass
*Attorney, Agent, or Firm*—Ralph W. Kalish

[57] ABSTRACT

A base wad for shotshells integrally constructed of non-linear polyethylene and a mineral from the class consisting of asbestos, barium carbonate, chalk, and talc in approximately equal portions by weight; said base wad being dimensionally stable, having requisite flowability for snug locking with the shotshell head and the rim thereof; and being of appropriate elasticity to provide excellent sealing of the gases of explosion while being readily restored to normal condition for ease of ejection of the shotshell from the gun firing chamber.

11 Claims, 1 Drawing Figure

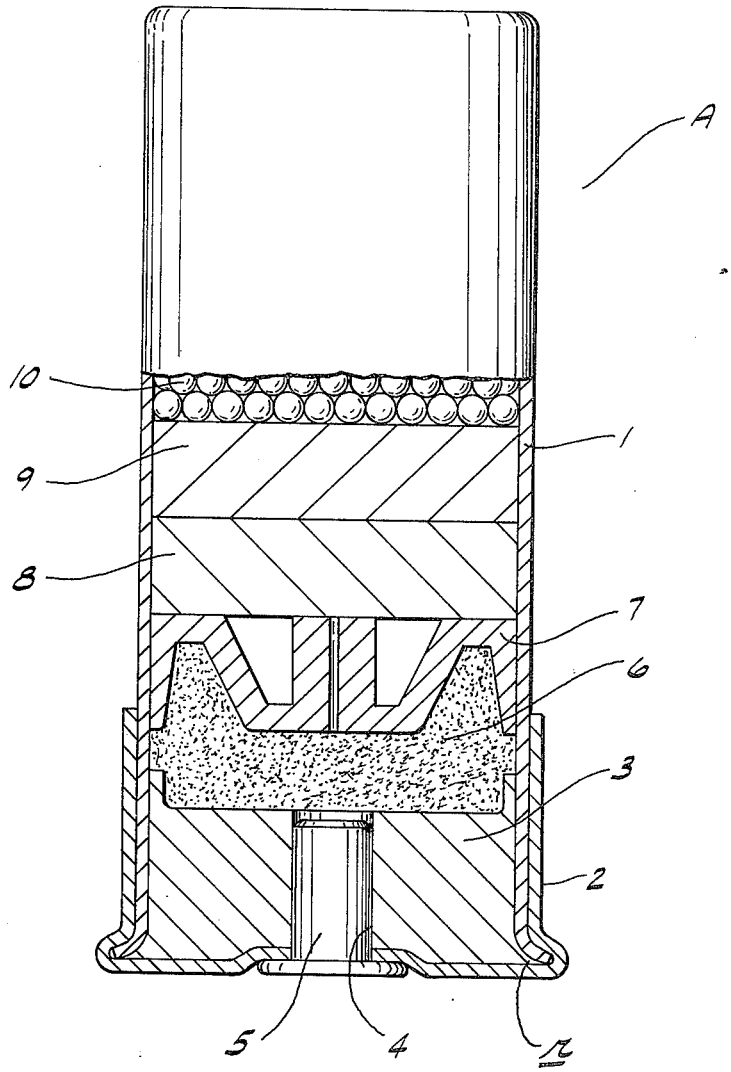
A
10
1
9
8
7
6
3
2
5
4
12

BASE WAD FOR SHOTSHELLS

This application is a continuation-in-part of application Ser. No. 429,094, filed Dec. 28, 1973, now abandoned.

BACKGROUND AND SUMMARY OF THE INVENTION

Heretofore, considerable efforts have been expended in developing and improving base wads for shotshells. The primary problem has been to incorporate within a single base wad all of the desired attributes thereof. A base wad must be adapted for interlock with the shotshell head, as by flowing into the rim portion thereof, for gas sealing purposes; as well as to provide a snug joint with the tube wall so that the force of the explosion, upon firing, will not be ineffectively dissipated. Additionally, it is of extreme criticality that a base wad be resistant to permanent deformation so that swelling, as it were, of the shotshell head is prevented for assuring ready ejectability or removal of the fired shotshell from the gun firing chamber. Base wads must necessarily embody appropriate elasticity so as to return to normal condition from any momentary distention or expansion upon firing. Furthermore, base wads must be dimensionally stable over long periods of time and without regard to the conditions of storage so that moisture gain or loss with attendant volumetric change does not occur to assure of optimum and consistent ballistic characteristics.

With the ever increasing demand for shotshells which are adapted for reloading by the individual shooter further requisites for base wads have become more evident, such as durability, so that the respective shotshell may be reloaded numerous times before there is any failure in the base wad. Also, economy is a serious factor.

The attempts to date to develop a base wad which contains the spectrum of desired properties have not been successful. In each instance at least one important deficiency has been present. Among such efforts has been the development of base wads of two-part construction embodying interlocking components; and the provision of base wad overlays, all of which prove most costly in production and of dubious gas sealing capabilities. Integrally formed wads have been primarily formed of convolute wound paper but the same frequently split upon firing which, understandably, brings about a swelling of the head for obstructing shell ejections. Furthermore, wads of cellulosic materials are subject to dimensional alteration by the absorption and loss of mositure through changes in ambient conditions. Base wads formed of plastic materials such as linear polyethylene have proved to be altogether too costly as well as extremely difficult in forming.

Another effort has been to mold a base wad from linear polyethylene and such is exemplified in the Comerford U.S. Pat. No. 3,269,311. Linear polyethylene is of high density and is relatively hard, being incapable of flowing sufficiently during the heading operation to properly lock into the head. Such linear polyethylene is too hard to retain a dish-shaped surface adjacent the propellant to provide an effective seal. If the heading pressure is increased to overcome this deficiency in flowability, the tube of the shell will be cut before arriving at a pressure high enough to reform such plastic. In view of the inherent resistance to reforming in the heading operation with resultant insufficient locking of such wads in the shell rim, the loss of the same from the shell after firing has been customarily encountered with such base wad remaining in the gun barrel and providing a condition where in the barrel may burst upon firing of the next shell. Accordingly, wads formed from linear polyethylene thus provide a very frightful hazard and because of their lack of capacity to reform, have not proved popular with the individual reloader.

Another prior art effort at developing a base wad is of the character shown in the Daubenspeck et al. U.S. Pat. No. 3,270,671 wherein the base wad is comprised of 30–60% of asbestos fibers and 70–40% of wood fibers, held together with a microcrystalline wax binder in a quantity equivalent to about 8% by weight of the asbestos wood fiber mixture. Wads of this particular type are not impervious to moisture and, hence, may absorb moisture from the powder or could, conversely, transfer absorbed moisture to the powder which in either case would have a severe and marked effect upon the ballistics. Furthermore, upon firing the temperatures developed are sufficient to effect some melting of the wax binder so that the outer surface of such base wads tends to fragment and become loose and thereby makes it extremely difficult, if not impossible, to reload the shell. An individual attempting to reload a base wad of the type now being discussed must use a hot spinning iron to repress the base wad before reloading to overcome the surface fragmentation. Also, it is evident that due to the moisture absorptive capacity of the base wads, the same are extremely sensitive to ambient conditions. It is evident that asbestos wood fiber base wads are not amenable to production by extrusion or injection molding but can only be formed by mechanical intermixing and subsequent compression.

Therefore, it is an object of the present invention to provide a base wad which may be most economically produced; which is readily formable so as to assure positive locking with the shotshell head; which is dimensionally stable, being resistant to moisture absorption or loss; which is highly durable; and which is resistant to failure so as to conduce to extensive reloadability of the associated shotshell.

It is another object of the present invention to provide a shotshell base wad which is constructed of a readily flowable, normally soft thermoplastic and mineral filler whereby the base wad is endowed with the elasticity and formability of the plastic together with the stability and strength contributed by the mineral.

It is a further object of the present invention to provide a base wad of the character stated which is amenable to high volume, rapid economic production by a variety of readily practiced methods.

It is a still further object of the present invention to provide a method for producing one-piece base wads of the present invention.

It is another object of the present invention to provide a base wad which is fireproof and thus being adapted for safe storage as well as conducing to nonhazardous reloading.

BRIEF DESCRIPTION OF THE DRAWING

The FIGURE is a side view of a shotshell, having a portion of the side wall broken away, and being in partial section, incorporating a base wad produced in accordance with and embodying the present invention.

DESCRIPTION OF THE PREFERRED EMBODIMENT

In essence, the present invention contemplates the construction of a base wad for shot gun shells, which by weight is constructed in substantially equal parts of non-linear polyethylene and a mineral, such as asbestos, barium carbonate, chalk, and talc; said latter sometimes being referred to herein as a filler. The non-linear polyethylene is normally relatively soft and is relatively low molecularly, and would not alone be adequate for base wad formation since the same would be entirely too soft for the requirements of a base wad. However, the same does inherently have a ready deformability as well as substantial elasticity. By the amalgamation with an appropriate relative quantity of the particular filler, a resultant composition is brought about which possesses the hardness and elasticity necessary for an effective base wad. By such unique combination the inherent characteristics of the non-linear polyethylene are adapted for base wad usage which was not heretofore conceived. If has been found that optimum base wad properties are developed by a composition which is approximately 50 percent by weight of the said non-linear polyethylene and approximately 50 percent by weight of the particular filler.

Base wads constructed in accordance with the present invention have proved extremely formable so that by the customary heading operation the same will flow adequately under compression to bring about an intimate and positive interlock with the head and especially within the rim volume. Thus, normal pressures may be used in such operation with full assurance that the intended interlock will be brought about; thereby assuring against any danger to the shell tube during reforming. By such formability excellent gas sealing is accorded the related shotshell as leakage is eliminated within the rim area, and furthermore, undesired relative dislodgment of the base wad is inhibited since the same is prevented from moving relatively upwardly within the shell upon firing. Furthermore, such properties permit of the development of the appropriate dish-shaped surface underlying the propellant charge to provide an effective seal.

The particular filler of the present invention uniquely modifies the inherent elasticity of the normally soft non-linear polyethylene so as to accord the resultant base wad with the desired resiliency so that the base wad will immediately return to normal dimensions subsequent to the expected initial expansion occurring upon explosion. By virtue of this capacity base wads so constructed will eliminate the danger of causing the shotshell to become jammed within the firing chamber or to contribute to any difficulty of extraction of the same. Manifestly, by such elasticity the base wads will maintain an especially tight joint with the cartridge tube immediately upon firing and thereby further conduce to prevention of gas leakage so that substantially the full force of explosion will be used for the propulsion of the wadding and the shot.

Furthermore, the particular filler of the present invention lends substantial strength to the base wad so that the same will have good contrast during percussion of the primer as well as resist deformation of the forces of explosion.

The non-linear polyethylene used by itself, that is, without modification by one of the present fillers, would be entirely too soft so that firing pressure would cause a swelling of the head of the shell and inhibit extracting of the fired shell from the gun.

In view of the foregoing it is indeed apparent that base wads so constructed are particularly suitable for shot gun cartridge reloading as effected by the average individual shooter; it being recognized that non-linear polyethylene and the present fillers are relatively cheap materials of construction and the integration of the same into a base wad may be achieved by practice of a most economically performed method.

The FIGURE of the drawing merely illustrates a shotshell designated generally A having the customary tubular casing 1, head 2, with a base wad 3 formed in accordance with the present invention and embodying the customary bore 4 for receiving a primer 5. A propellant charge 6 is provided upon base wad 3 with there being an obturating wad 7 surmounting said charge 6 and with the customary filler or separator wads 8, 9 disposed thereabove. A so-called missile charge 10 is disposed above wad 9 and the upper end portion of casing 1 may be folded inwardly, crimped, or otherwise closed for completing the assembly of shotshell A. Said drawing is provided merely for purposes of reference for clarifying the relationship of base wad 3 with the other components of shotshell A, and particularly for depicting the snug lock within the rim of head 2 indicated at *r*.

Extensive testing has demonstrated that the present base wads are dimensionally stable, as the unique composition of the same is not measurably absorptive of moisture, thus being proof against moisture transfer in either direction with respect to the propellant charge so as to assure of consistent and reliable ballistics without regard to the number of firings. Accordingly, no processing steps of any type are required for reloading.

Base wads of this invention may be prepared by a method which is especially suited for commercial production; the same encompassing the utilization of pellets or scrap of non-linear polyethylene which has been preferably ground for passing an 8 mesh screen and with scrap asbestos fiber. Said raw materials are charged in substantially equal amounts to a mechanical mixer. After the mixing operation the resultant mass is then inserted in an extruder for extrusion in rod form. The extruded rod is then subjected to a chopping operation with the resultant particles being then submitted to a further extruding operation for assuring the complete intermixing of the asbestos. The second extruding operation provides a relatively thick-walled tube. The latter may be cut in desired increments and with the severed portions being then subjected to conventional forming operations as by suitable dies to complete the base wad construction and the latter may then be subjected to the customary heading operation as by subjection to an internal punch under substantial pressure for causing material of the base wad to flow into the rim area of the head.

However, it is to be understood that instead of asbestos fiber, barium carbonate, chalk or talc may be used without any alteration in the method.

It will be observed that the present base wad has but two components, namely the non-linear polyethylene and the filler from the group comprised of asbestos, talc, chalk and barium carbonate; there being no need for a binder or adhesive, such as wax or the like. Formed in the manner herein taught, base wads of the present invention have maximum physical integrity so that fragmenting, splitting, rupturing, deforming do not occur on shell firing. The above fillers unexpectedly cooperate with the non-linear polyethylene to give the resultant base wad such physical integrity as well as the requisite flowability which could not be obtained from non-linear polyethylene alone.

Accordingly, in view of the foregoing, it will be seen that the unique combination of low density, normally soft, relatively low molecular, non-linear polyethylene and a mineral from the class consisting of asbestos, barium carbonate, chalk and talc brings about a resultant base wad with requisite hardness, yet improved primer sensitivity; excellent extraction; superb interlock with the shell head being substantially non-moisture absorptive and also excellent physical integrity, there being no swelling after firing.

Having described my invention, what I claim and desire to obtain by Letters Patent is:

1. A shotshell base or under powder wad having a unitary, integrally formed body consisting essentially of a normally soft, relatively low molecular, non-linear, non-copolymerized thermoplastic and a naturally occurring mineral, said body having uniform consistency throughout its extent.

2. A shotshell base wad as defined in claim 1 and further characterized by said thermoplastic and said mineral each constituting approximately 50 percent by weight of the base wad.

3. A shotshell base wad as defined in claim 2 and further characterized by said thermoplastic being non-linear, low density low molecular weight, non-copolymerized polyethylene.

4. A shotshell base wad as defined in claim 3 and further characterized by said mineral being from the class consisting of asbestos, barium carbonate, chalk, and talc.

5. A shotshell base wad as defined in claim 3 and further characterized by said mineral being asbestos.

6. The combination with a shotshell having a tubular casing and a head, said head having a rim, of a base or under powder wad disposed in said casing and interlocked with said shotshell head and the rim thereof, said base wad comprising a unitary body integrally formed and consisting essentially of a normally soft, relatively low molecular weight, low density, non-linear, non-copolymerized, substantially water insoluble polyethylene and a naturally occurring mineral, said body being of uniform consistency throughout its extent.

7. The combination as defined in claim 6 and further characterized by said mineral being from the class consisting of asbestos, barium carbonate, chalk and talc.

8. The combination as defined in claim 6 and further characterized by said non-linear polyethylene and said mineral each constituting approximately 50 percent by weight of the base wad body.

9. A shotshell base wad having an integrally formed body consisting essentially of a normally soft, relatively low molecular weight, low density, non-linear, non-copolymerized polyethylene and a mineral from the class consisting of asbestos, barium carbonate, chalk and talc.

10. A shotshell base wad as defined in claim 9 and further characterized by said non-linear polyethylene and said mineral each constituting approximately 50 percent by weight of the base wad.

11. In combination with a shotshell having a tubular casing and a head, said head having a rim, a base wad disposed in said casing and interlocked with said head rim, said base wad consisting of a body integrally formed from normally soft, relatively low molecular weight non-linear, non-copolymerized polyethylene and asbestos, said non-linear polyethylene and said asbestos each constituting approximately 50% by weight of the base wad body.

* * * * *